United States Patent [19]

Bocher

[11] Patent Number: 4,625,187

[45] Date of Patent: Nov. 25, 1986

[54] RADIATING COAXIAL ELECTRIC CABLE

[75] Inventor: Jean-Loup Bocher, Ermont, France

[73] Assignee: Les Cables de Lyon, Clichy, France

[21] Appl. No.: 651,730

[22] Filed: Sep. 17, 1984

[30] Foreign Application Priority Data

Sep. 15, 1983 [FR] France ..... 83 14710

[51] Int. Cl.[4] ..... H01P 3/06

[52] U.S. Cl. ..... 333/237; 333/243

[58] Field of Search ..... 333/237; 343/770, 771

[56] References Cited

U.S. PATENT DOCUMENTS

| | | | |
|---|---|---|---|
| 2,633,532 | 3/1953 | Sichak | 343/771 |
| 4,152,648 | 5/1979 | Delogne | 333/237 X |
| 4,300,338 | 11/1981 | Harman et al. | 333/237 X |
| 4,339,733 | 7/1982 | Smith | 333/237 |

FOREIGN PATENT DOCUMENTS

| | | | |
|---|---|---|---|
| 76814 | 6/1977 | Japan | 333/237 |
| 1424685 | 2/1976 | United Kingdom . | |
| 1597125 | 9/1981 | United Kingdom . | |

OTHER PUBLICATIONS

Nagao et al, International Antenna and Propagation Symposium, Sep. 9–11, 1968, pp. 253–258, Boston Mass. USA.

*Primary Examiner*—Paul Gensler

*Attorney, Agent, or Firm*—Sughrue, Mion, Zinn, Macpeak, and Seas

[57] ABSTRACT

Radiating coaxial electric cable comprises a conductor core (1), a cellular dielectric (2), an outer conductor (3) having apertures for the passage of electromagnetic radiation, and an outer insulating sheath (4). The radiation-passing apertures consist of successive series of holes (6) aligned according to a helix segment pattern.

6 Claims, 1 Drawing Figure

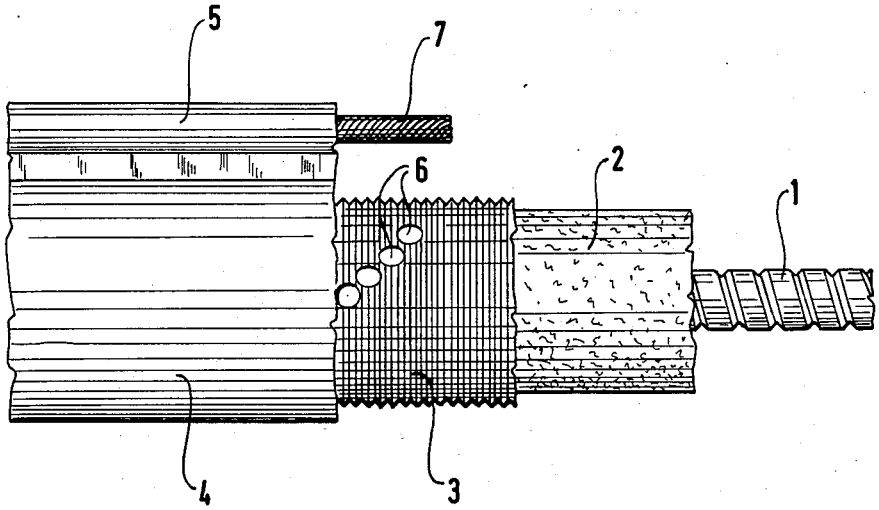
5
7
6
2
1
4
3

RADIATING COAXIAL ELECTRIC CABLE

The present invention concerns a radiating coaxial electric cable, comprising a conductor core, a cellular dielectric, an outer conductor having apertures for the passage of electromagnetic radiation, and an outer insulating jacket.

The apertures for passage or radiation in known cables consist either of slots which may be arranged longitudinally or at an angle to the axis of the cable, or of a series of holes aligned with segments parallel to the axis of the cable. Their attenuation per unit length however is disturbed by the value of the coupling factor. Consequently, they are fully satisfactory only for given coupling factors. Their peak value radiation is also limited.

Radiating cables with slots arranged at an angle to the cable axis are particularly dissipative as these slots cut the surface currents flowing through the cable's outer conductor and thus considerably augment attenuation.

Cables with a series of holes aligned along segments parallel to the cable axis have a lower attenuation, but the arrangement of these segments parallel to the axis creates an inconsistent radiation diagram which may cause problems in many applications.

The present invention is directed to providing a radiating coaxial electric cable the attenuation coefficient whereof is not dependent on the value of the coupling factor, having better peak value radiation with more uniform distribution and for smaller coupling magnitudes than the known cables and for which the measuring of echo voltages (reflectometry) is very good.

The cable according to the present invention is characterized in that the radiation-passing apertures of its outer conductor consist of successive series of holes arranged in a helix segment pattern.

It moreover preferably meets at least one of the following specifications:

The radiation-passing holes are circular.

The outer conductor consists of a corrugated sheet.

Its sheath is made from synthetic resin with a mineral additive making it non-flame-propagating.

The sheath is free from halogenated additives.

The apparent density of the cellular dielectric falls between 0.25 and 0.50 g/cm$^3$.

Its outer sheath is connected to a carrying element having its axis parallel to the cable axis.

It is known that the energy $\Delta W$ radiated by each hole of radius r at a frequency $f=\omega/2\pi$ is given by the Bethe equation as follows:

$$\Delta W = \frac{2\omega^2 r^6}{27\pi^2 c} H_t^2$$

where $H_t$ is the magnetic field which is tangential to the center of the opening and c the velocity of light in a vacuum.

The additional attenuation due to the radiation may thus be calculated as $\Delta\alpha=\Delta W/W$, where W stands for the energy carried in the cable.

Since the holes are arranged in a helix pattern in relation to the cable axis, the radiation of said cable has a circular diagram and is the same in all directions, provided the barrier effect due to obstacles located close to the cable is disregarded.

The distance d between the holes must be selected such that the radiated fields from each hole will be cumulative. This leads to a theoretical requirement as follows: radiation by the "leaky" cable will be effective for carrier signals having a free air wavelength satisfying the two relations $$\lambda \leqq (1 + \sqrt{\epsilon r_1}\,)\frac{d}{|p|} \text{ and}$$

$$\lambda \geqq (\sqrt{\epsilon r_1} - 1)\frac{d}{|p|}$$

where p is a whole constant and $\epsilon r_1$ is the relative permittivity of the coaxial cable's primary insulation.

Depending on the value of p, the radiation will occur at the fundamental mode or at higher order modes.

BRIEF DESCRIPTION OF THE DRAWING

A radiating coaxial electric cable according to the invention will now be described by way of example and with reference to the sole appended FIGURE.

Said cable comprises a conductor core 1 of helically grooved copper or aluminum. This inner conductor is surrounded by a low-loss polyethylene cellular dielectric 2 having a density in the range 0.25 to 0.50 g/cm$^3$.

The outer conductor is made from a corrugated copper strip 3 containing holes 6 distributed according to a helix segment pattern, the pitch and angular positioning of the holes series in relation to the axis being selected as a function of the use frequency. The holes shown in the drawing are circular, but they could also be rectangular or oval shaped.

The outer conductor is surrounded by a protective sheath 4 of polyvinyl chloride with a mineral filling making it non-flame-propagating but is free from any halogenated fireproofing additive that would generate halogen fumes in the event of a fire.

The cable as a whole is supported by a carrying element 5 with a steel core 7, connected to the cable sheath.

Such a cable, having outside and inside diameters of 45 mm and 18.5 mm respectively and provided with 9 mm-diameter holes spaced 15 mm apart in a helix pattern with a pitch of 350 mm, affords a free-space coupling efficiency of −53 dB at 2 meters' distance with an attenuation of 23 dB/km. Its characteristic impedance is roughly 50 ohms. A cable according to the prior art, as described by Nagao, Kurauchi and Nakahara in International Antenna and Propagation Symposium, Sept. 9–11, 1968, pages 253–258, with outside and inside diameters of 43 mm and 17.7 mm respectively and provided with 130 mm long by 10 mm wide slots arranged at alternating angles with respect to the axis of +0.3 radian and −0.3 radian at a pitch of 530 mm, provided a free-space coupling efficiency of −57 dB at 2 meters' distance with an attenuation of 24 dB/km.

I claim:

1. A radiation coaxial electric cable comprising a conductor core (1), a cellular dielectric (2), a single, continuous outer conductor (3) having apertures for the passage of electromagnetic radiation, and an outer insulating sheath (4), wherein the radiation-passing apertures consist of successive series of circular holes (6) aligned according to helix pattern, thereby providing a radiating coaxial electric cable whose attenuation coefficient thereof is not dependent upon the value of the coupling factor, having better peak value radiation with more uniform distribution and for smaller coupling magnitudes than known cables and which permits excellent measuring of echo voltages.

2. A cable as claimed in claim 1, characterized in that its outer conductor is formed by a corrugated strip.

3. A cable as claimed in claim 1, characterized in that its sheath is made from a synthetic resin with a mineral additive making it non-flame-propagating.

4. A cable as claimed in claim 1, characterized in that the sheath is free from any halogenated additive.

5. A cable as claimed in claim 1, characterized in that the apparent density of the cellular dielectric lies in the 0.25 to 0.50 g/cm$^3$ range.

6. A cable as claimed in claim 1, characterized in that its outer sheath is connected to a carrying element (5) the axis whereof is parallel to the cable axis.

* * * * *